US009495834B2

(12) United States Patent
Wright et al.

(10) Patent No.: US 9,495,834 B2
(45) Date of Patent: Nov. 15, 2016

(54) APPARATUS AND METHOD FOR DETERMINING THE AWARD OF A PLURALITY OF PRIZES

(75) Inventors: Dean Wright, Taren Point (AU); Stephen Cowan, Taren Point (AU); Ali Jomaa, Taren Point (AU)

(73) Assignee: Paltronics Australasia Pty Limited, New South Wales (AU)

( * ) Notice: Subject to any disclaimer, the term of this patent is extended or adjusted under 35 U.S.C. 154(b) by 533 days.

(21) Appl. No.: 12/670,418

(22) PCT Filed: Jul. 28, 2008

(86) PCT No.: PCT/AU2008/001090

§ 371 (c)(1),
(2), (4) Date: Jan. 25, 2010

(87) PCT Pub. No.: WO2009/012535

PCT Pub. Date: Jan. 29, 2009

(65) Prior Publication Data

US 2010/0197384 A1 Aug. 5, 2010

(30) Foreign Application Priority Data

Jul. 26, 2007 (AU) ..... 2007904022

(51) Int. Cl.
*A63F 9/24* (2006.01)
*G07F 17/32* (2006.01)

(52) U.S. Cl.
CPC ..... *G07F 17/3258* (2013.01)

(58) Field of Classification Search
USPC ..... 463/20, 30, 25–27
See application file for complete search history.

(56) References Cited

U.S. PATENT DOCUMENTS

| | | | | |
|---|---|---|---|---|
| 4,101,129 | A | 7/1978 | Cox | |
| 5,280,909 | A | 1/1994 | Tracy | |
| 5,344,144 | A * | 9/1994 | Canon | 463/27 |
| 5,855,515 | A * | 1/1999 | Pease et al. | 463/27 |
| 5,885,158 | A * | 3/1999 | Torango et al. | 463/27 |
| 6,012,982 | A | 1/2000 | Piechowiak et al. | |
| 6,015,346 | A * | 1/2000 | Bennett | 463/20 |
| 6,089,976 | A * | 7/2000 | Schneider et al. | 463/16 |
| 6,110,043 | A | 8/2000 | Olsen | |

(Continued)

FOREIGN PATENT DOCUMENTS

| | | |
|---|---|---|
| CA | 2544446 A1 | 8/1995 |
| EP | 1513118 A2 | 3/2005 |

(Continued)

*Primary Examiner* — Jason Skaarup
(74) *Attorney, Agent, or Firm* — Brooks Kushman P.C.

(57) ABSTRACT

Apparatus is disclosed for determining the award of a set of prizes where each prize in the set has a respective prize value. The apparatus includes memory for storing prize data indicative of the prize values in the set. An input device is responsive to input signals from a respective plurality of gaming terminals for providing an increment signal. An increment device accesses the prize data to select at least two prize values from the set to define respective current prize values, and is responsive to the increment signal for incrementing in parallel a plurality of accumulated values toward the respective current prize values. A comparator is responsive to the current prize values and the accumulated values for determining if one of the current prize values is to be awarded and, if so, generating an award signal and removing from the set the prize value corresponding to the one of the current prize values.

19 Claims, 5 Drawing Sheets

(56) References Cited

U.S. PATENT DOCUMENTS

| | | | | |
|---|---|---|---|---|
| 6,146,273 | A * | 11/2000 | Olsen | 463/27 |
| 6,159,098 | A * | 12/2000 | Slomiany et al. | 463/25 |
| 6,217,448 | B1 * | 4/2001 | Olsen | 463/25 |
| 6,241,608 | B1 * | 6/2001 | Torango | 463/27 |
| 6,358,149 | B1 | 3/2002 | Schneider et al. | |
| 6,565,434 | B1 | 5/2003 | Acres | |
| 7,056,215 | B1 * | 6/2006 | Olive | 463/27 |
| 7,568,973 | B2 * | 8/2009 | Iddings et al. | 463/25 |
| 7,597,621 | B2 * | 10/2009 | Baerlocher | 463/28 |
| 7,753,782 | B2 * | 7/2010 | Cuddy et al. | 463/26 |
| 7,794,322 | B2 * | 9/2010 | Schneider | G06Q 30/02 463/16 |
| 7,837,555 | B2 * | 11/2010 | Cowan | G06Q 30/02 463/25 |
| 7,841,939 | B2 * | 11/2010 | Baerlocher et al. | 463/25 |
| 8,128,491 | B2 * | 3/2012 | Vasquez et al. | 463/27 |
| 8,353,753 | B2 * | 1/2013 | Thomas | G07F 17/3258 273/138.1 |
| 2005/0054435 | A1 * | 3/2005 | Rodgers et al. | 463/25 |
| 2005/0239542 | A1 * | 10/2005 | Olsen | 463/27 |
| 2007/0149267 | A1 | 6/2007 | Ross et al. | |
| 2007/0191088 | A1 * | 8/2007 | Breckner et al. | 463/20 |
| 2007/0218982 | A1 * | 9/2007 | Baerlocher | 463/27 |

FOREIGN PATENT DOCUMENTS

| | | | |
|---|---|---|---|
| GB | 2334897 | A | 9/1999 |
| WO | 2005008514 | A1 | 1/2005 |
| WO | 2005107912 | A1 | 11/2005 |
| WO | 2007045020 | A1 | 4/2007 |

* cited by examiner

APPARATUS AND METHOD FOR DETERMINING THE AWARD OF A PLURALITY OF PRIZES

FIELD OF INVENTION

The present invention relates to an apparatus and method for determining the award of a plurality of prizes.

The invention has been developed primarily for use with a plurality of interlinked gaming machines in a gaming establishment and will be described hereinafter with reference to that application. However, the invention is not limited to that particular field of use and is also suitable for use with online gaming, gaming machines that are distributed over a plurality of gaming establishments, lotto, pools, lotteries, art unions, bingo, raffles and other games involving one or more wagers being placed upon an outcome having a finite probability of occurring.

BACKGROUND

It is known to "link" gaming machines to provide a number of additional functionalities. This includes the ability to control the awarding of a prize, as the pool of available funds is greater and the amount of funds available is known rather than having to be estimated. Another functionality of interlinked gaming machines is that secondary gaming is possible in which a jackpot prize is available to be awarded. For example, for a given group of interlinked gaming machines, a central display provides the garners with a visual indication of an accumulating amount that is being incrementally increased as the garners operate the interlinked gaming machines. It is known by the garners that the prize will be awarded when it is incremented to a randomly selected value that is less than a predefined value. Typically, the predefined value will also be visually indicated to the garners by the display.

It is also known to provide a number of jackpot "prize levels", in that a plurality of jackpot prizes is simultaneously available to be awarded to the garners of the machine participating in the secondary game. Typically each level is defined by a range from which the respective prize value is randomly chosen, and the ranges of the levels can but often do not overlap. As the gaming machines are operated to allow the garners to play the respective primary games a contribution of each wager made in the primary game is contributed to the secondary game. The contributions are provided by the individual gaming machines to a jackpot controller as part of respective input signals. The jackpot controller is responsive to the input signals for providing an increment signal for each prize level which, in turn, increments the respective accumulating amounts for those levels toward the respective prize value for that level. Once a given accumulating amount reaches the prize value for the given level, the respective prize is awarded and a new prize value is selected for that level and the increments of the accumulating values continue.

The use of such functionality is intended to provide additional impetus to the garners to play the machines and thereby win the jackpot prize in addition to any prize available to be awarded by the respective machine. However, with the increasing sophistication of the gainers and their approach to gaming, the interest in the jackpot prize has diminished.

The use of levels is easily applied to larger gaming venues where there are many gaming terminals in use at any given time. The volume of wagers ensures that prizes are awarded regularly, and that the value of the prizes—which are usually randomly determined—for each level quickly approaches the average of the range defined by the respective level. However, for smaller venues particularly, where wagers are usually lesser in number and quantum, it takes longer for prizes to be awarded and longer for the average prize value awarded for each level to approximate to the average of the range defined by the respective level. This can lead to difficulties for the operating in managing costs and maintaining a payout percentage to the gamers during the lower turnover periods.

The discussion of the prior art within this specification is to assist the addressee understand the invention and is not an admission of the extent of the common general knowledge in the field of the invention and is included without prejudice.

SUMMARY OF THE INVENTION

It is an object of the present invention to overcome, or at least substantially ameliorate, one or more of the disadvantages of the prior art or at least to provide a useful alternative.

According to a first aspect of the invention there is provided an apparatus for determining the award of a set of prizes where each prize in the set has a respective prize value, the apparatus including:

memory for storing prize data indicative of the prize values in the set;

an input device being responsive to input signals from a respective plurality of gaming terminals for providing an increment signal;

an increment device for: accessing the prize data to select at least two prize values from the set to define respective current prize values; and being responsive to the increment signal for incrementing in parallel a plurality of accumulated values toward the respective current prize values; and a comparator being responsive to the current prize values and the accumulated values for determining if one of the current prize values is to be awarded and, if so, generating an award signal and removing from the set the prize value corresponding to the one of the current prize values.

In an embodiment, the increment signal includes increment data associated with each prize value in the set and the increment device is responsive to the increment data for selectively incrementing the respective accumulated values. Preferably, the increment data is indicative of a plurality of weightings associated with respective prize values in the set. More preferably, each weighting is greater than zero. In some embodiments, the input device is responsive to the input signals received during a first polling period for setting at least one weighting at greater than zero. Preferably, the input device is responsive to the input signals received during the first polling period for setting all weightings at greater than zero.

In an embodiment, the input device is responsive to the input signals received during a second polling period subsequent to the first for setting at least one weighting at greater than zero. Preferably, the input device is responsive to the input signals received during the second polling period for setting all weightings at greater than zero. More preferably, the weightings remain fixed for the first and second polling periods.

In an embodiment, the input signals provide contribution data, and the input device is responsive to the contribution data for defining the increment data. Preferably, the contribution data is indicative of a financial contribution.

In an embodiment, the comparator is responsive to the award signal for determining if the set contains any prize values that have not defined a corresponding current prize value.

According to a second aspect of the invention there is provided an apparatus for determining the award of a plurality of prizes where each prize has a respective prize value and a respective accumulation state, the apparatus including:

memory for storing data indicative of the prize values and the accumulation states;

an input device being responsive to input signals from a respective plurality of gaming terminals for providing an increment signal;

an increment device that is responsive to: the prize values for defining respective current prize values; and the increment signal and the accumulation state for selectively incrementing in parallel toward the current prize values respective accumulated values;

a comparator being responsive to the current prize values and the accumulated values for determining if one or more of the current prize values are to be awarded and, if so, generating an award signal; and a processor that is responsive to the award signal for selectively refreshing the accumulation states such that the increment device does not increment the accumulated values associated with the one or more of the current prize values.

In an embodiment, the processor is responsive to the award signal for refreshing all the accumulation states. Preferably, the refreshing of the accumulation states includes: changing the accumulation states; or re-writing an existing state.

In an embodiment, the accumulation states are such that the increment device initially increments in parallel all the accumulated values. Preferably, the processor is responsive to successive award signals for reducing the number of accumulated values being incremented in parallel by the increment device.

In an embodiment, the accumulation states are such that the increment device initially increments in parallel a predetermined number of the accumulated values, where the predetermined number is less than the available number of prizes. Preferably, the processor, in response to the award signal, refreshes the accumulation states such that the predetermined number of accumulated values are being incremented in parallel.

In an embodiment, the allocation state is indicative of an allocation value for the respective prize.

In an embodiment, the increment device is responsive to the allocation values for determining the increment to the respective accumulated values.

In an embodiment, the allocation values are relative weightings for the respective prizes.

According to a third aspect of the invention there is provided an apparatus for determining the award of a plurality of prizes where each prize has a respective prize value, the apparatus including:

memory for storing data indicative of the prize values;

an input device being responsive to input signals from a respective plurality of gaming terminals for providing an increment signal;

an increment device that is responsive to: the prize values for defining respective current prize values; and the increment signal for selectively incrementing in parallel toward the current prize values respective accumulated values;

a comparator being responsive to the current prize values and the accumulated values for determining if one or more of the current prize values are to be awarded and, if so, generating an award signal; and a processor that is responsive to the award signal for selectively refreshing the data such that the increment device does not increment the accumulated values associated with the one or more of the current prize values.

According to a fourth aspect of the invention there is provided an apparatus for determining the award of a plurality of prizes where each prize has a respective prize value, the apparatus including:

memory for storing data indicative of the prize values;

an input device being responsive to input signals from a respective plurality of gaming terminals for providing an increment signal;

an increment device that is responsive to: the prize values for defining respective current prize values; and the increment signal for selectively incrementing in parallel toward the current prize values respective accumulated values;

a comparator being responsive to the current prize values and the accumulated values for determining if one or more of the current prize values are to be awarded and, if so, generating an award signal; and a processor that is responsive to the award signal for selectively refreshing the data such that the increment device only increments the accumulated values associated with other than the one or more of the current prize values.

According to a fifth aspect of the invention there is provided an apparatus for determining the award of a plurality of prizes where each prize has a respective prize value and a respective weighting, the apparatus including:

memory for storing data indicative of the prize values and the weightings;

an input device being responsive to input signals from a respective plurality of gaming terminals for providing an increment signal;

an increment device that is responsive to: the prize values for defining respective current prize values; and the increment signal and the weightings for selectively incrementing in parallel toward the current prize values respective accumulated values;

a comparator being responsive to the current prize values and the accumulated values for determining if one or more of the current prize values are to be awarded and, if so, generating an award signal; and a processor that for selectively refreshing the data to change the weightings.

In an embodiment, the input signals are grouped in a plurality of batches for a corresponding plurality of successive polling periods and the input device is responsive to the signals within each batch for providing the increment signal for each polling period. Preferably, the processor refreshes the data for one or more of the polling periods. Preferably also, the processor refreshes the data for all of the polling periods.

In an embodiment, the processor is responsive to the award signal in respect of one of the batches for refreshing the data prior to the increment device being responsive to the increment signal for the batch for the next polling period.

In an embodiment, the processor refreshes the data to provide one or more of:

a change in one or more of the weightings;

a change in one or more of the weightings to zero; and a change in one or more of the weightings to greater than zero.

According to a sixth aspect of the invention there is provided a method for determining the award of a set of prizes where each prize in the set has a respective prize value, the method including the steps of:

storing prize data indicative of the prize values in the set;

an input device being responsive to input signals from a respective plurality of gaming terminals for providing an increment signal;

accessing the prize data to select at least two prize values from the set to define respective current prize values;

being responsive to the increment signal for incrementing in parallel a plurality of accumulated values toward the respective current prize values; and being responsive to the current prize values and the accumulated values for determining if one of the current prize values is to be awarded and, if so, generating an award signal and removing from the set the prize value corresponding to the one of the current prize values.

According to a seventh aspect of the invention there is provided a method for determining the award of a plurality of prizes where each prize has a respective prize value and a respective accumulation state, the method including the steps of:

storing data indicative of the prize values and the accumulation states;

being responsive to input signals from a respective plurality of gaming terminals for providing an increment signal;

providing an increment device that is responsive to: the prize values for defining respective current prize values; and the increment signal and the accumulation state for selectively incrementing in parallel toward the current prize values respective accumulated values;

being responsive to the current prize values and the accumulated values for determining if one or more of the current prize values are to be awarded and, if so, generating an award signal; and a processor that is responsive to the award signal for selectively refreshing the accumulation states such that the increment device does not increment the accumulated values associated with the one or more of the current prize values.

According to an eighth aspect of the invention there is provided a method for determining the award of a plurality of prizes where each prize has a respective prize value, the method including:

storing data indicative of the prize values;

being responsive to input signals from a respective plurality of gaming terminals for providing an increment signal;

providing an increment device that is responsive to: the prize values for defining respective current prize values; and the increment signal for selectively incrementing in parallel toward the current prize values respective accumulated values;

being responsive to the current prize values and the accumulated values for determining if one or more of the current prize values are to be awarded and, if so, generating an award signal; and being responsive to the award signal for selectively refreshing the data such that the increment device does not increment the accumulated values associated with the one or more of the current prize values.

According to a ninth aspect of the invention there is provided a method for determining the award of a plurality of prizes where each prize has a respective prize value, the method including the steps of:

storing data indicative of the prize values;

being responsive to input signals from a respective plurality of gaming terminals for providing an increment signal;

providing an increment device that is responsive to: the prize values for defining respective current prize values; and the increment signal for selectively incrementing in parallel toward the current prize values respective accumulated values;

being responsive to the current prize values and the accumulated values for determining if one or more of the current prize values are to be awarded and, if so, generating an award signal; and being responsive to the award signal for selectively refreshing the data such that the increment device only increments the accumulated values associated with other than the one or more of the current prize values.

According to a tenth aspect of the invention there is provided a method for determining the award of a plurality of prizes where each prize has a respective prize value and a respective weighting, the method including the steps of:

storing data indicative of the prize values and the weightings;

being responsive to input signals from a respective plurality of gaming terminals for providing an increment signal;

being responsive to the prize values for defining respective current prize values;

being responsive to the increment signal and the weightings for selectively incrementing in parallel toward the current prize values respective accumulated values;

being responsive to the current prize values and the accumulated values for determining if one or more of the current prize values are to be awarded and, if so, generating an award signal; and selectively refreshing the data to change the weightings.

BRIEF DESCRIPTION OF THE DRAWINGS

A preferred embodiment of the invention will now be described, by way of example only, with reference to the accompanying drawings, in which.

DETAILED DESCRIPTION OF THE PREFERRED EMBODIMENTS

At least some of the embodiments of the invention make use of certain elements of hardware and software similar to that disclosed in PCT application PCT/AU2004/000964 the disclosure of which is incorporated herein by way of cross-reference.

Figure 1:
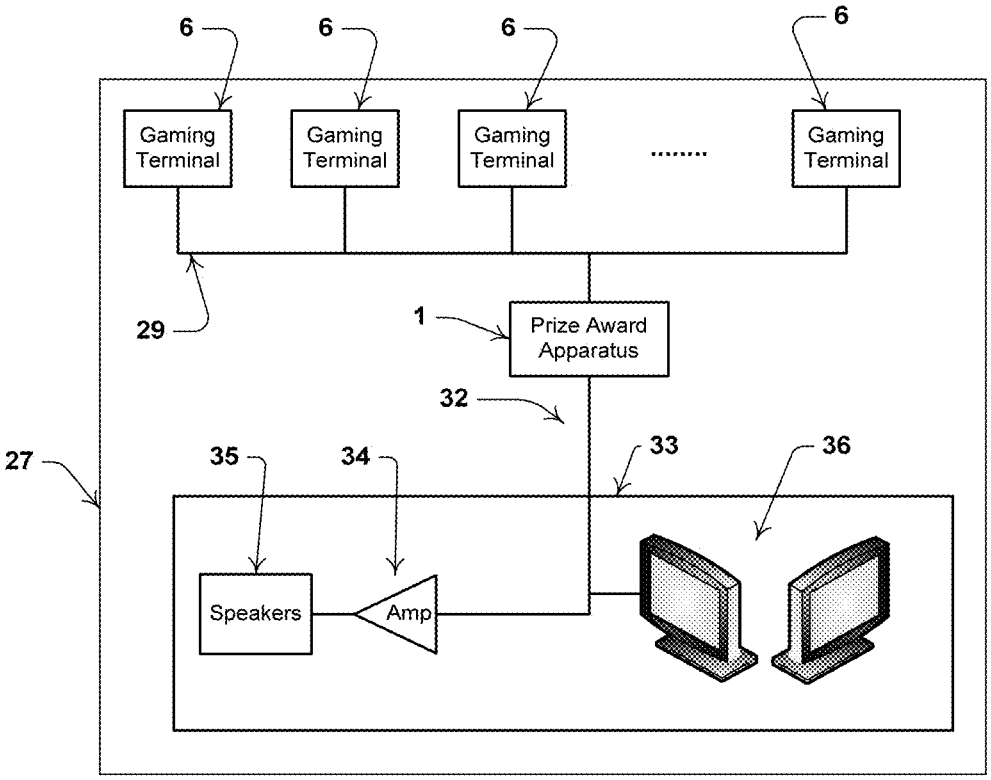
FIG. 1 is a schematic view of a gaming network including an apparatus according to the invention.
Figure 2:
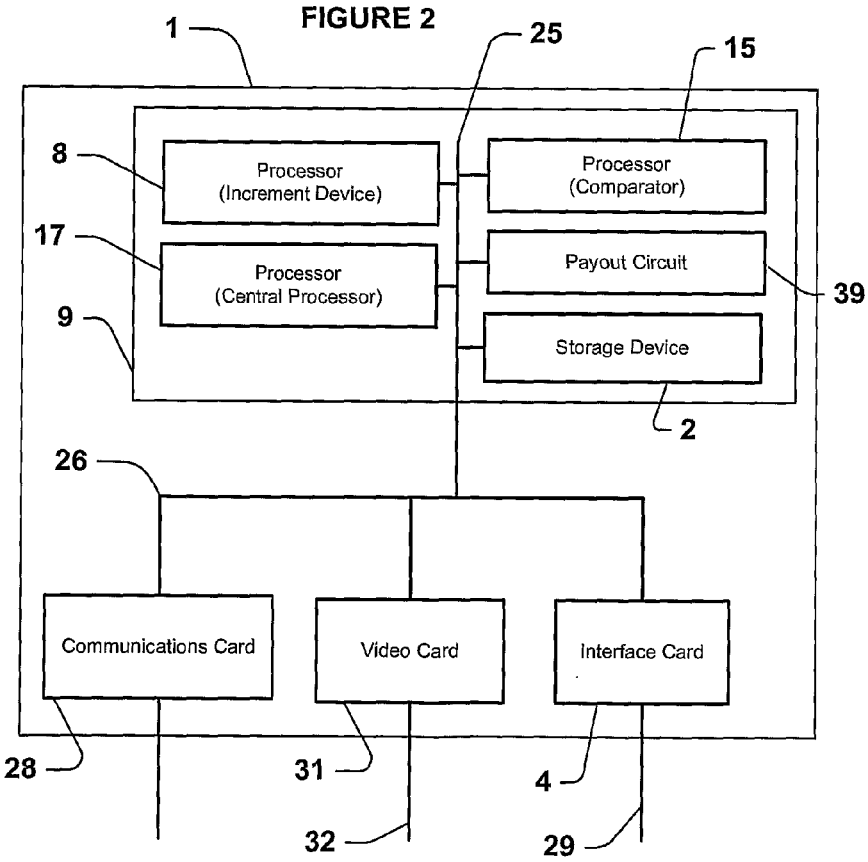
FIG. 2 is a schematic view in more detail of the apparatus shown in FIG. 1.
Figure 5:
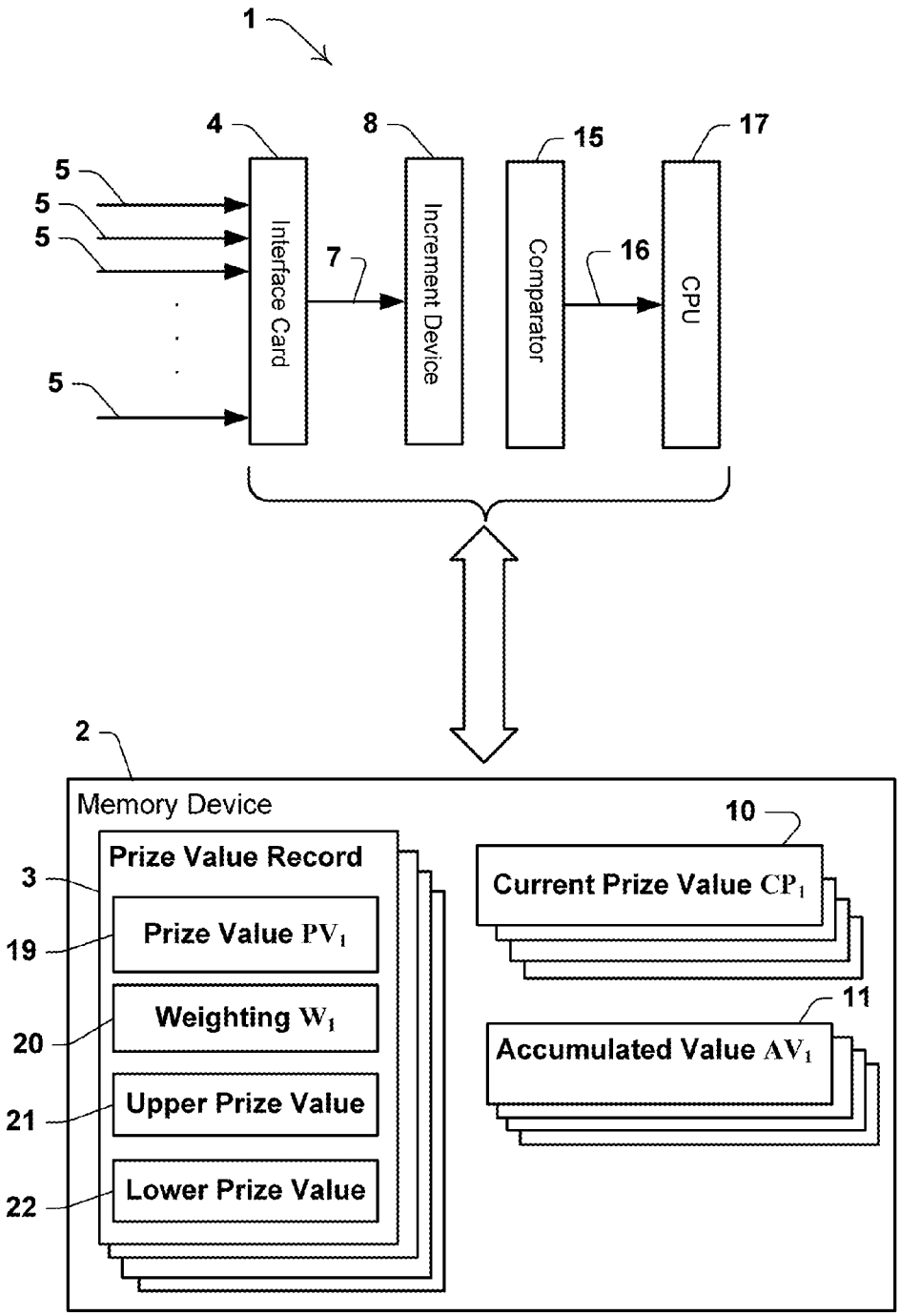
FIG. 5 is a schematic representation of some of the data flows occurring during the operation of the apparatus of FIG. 2.

Referring to FIG. 2 and FIG. 5 there is provided an apparatus 1 for determining the award of a plurality of prizes in the form of a set of prizes where each prize in the set has a respective prize value. The apparatus includes memory in the form of a memory device 2 for storing data indicative of the prize values, where the data is in the form of prize value records 3. An input device, in the form of a serial electronic interface (SEI) card 4, is responsive to input signals 5 from a respective plurality of gaming terminals 6—where terminals 6 are shown in FIG. 1—for providing an increment signal 7. An increment device, in the form of a local processor 8, is mounted to a motherboard 9 and is responsive to records 3 to define a plurality of current prize values 10, where those current prize values are individually referred to as CP1, CP2, . . . , CPx, where x>1. Processor 8 is also responsive to signal 7 for selectively incrementing in parallel toward the current prize values 10 respective accumulating values 11. The individual accumulating values are referred to as AV1, AV2 . . . , AVx. A comparator, in the form of a further local processor 15, is also mounted to motherboard 9, and is responsive to the current prize values 10 and values 11 for determining if one or more of the current prize values 10 are to be awarded and, if so, generating an award signal 16. A processor, in the form of a central processor 17, is also mounted to motherboard 9 and is responsive to the award signal 16 for selectively refreshing records 3 such that processor 8 does not increment the values 11 associated with the one or more of the current prize values.

The records 3 each include at least four fields for each prize, these being:

- A prize value field 19 that is indicative of the financial quantum of the prize value for each prize. The prize values include $PV_1, \ldots, PV_y$, where y>1.
- A weighting field 20 which is indicative of the relative amount of an available increment for a polling period that should be applied to the accumulated value for the prize. The weightings are individual referred to as $W_1, \ldots, W_y$.
- An upper prize value 21 which is a maximum value for the prize value, and which is displayed to the garners if the accumulated amount is being incremented upwardly.
- A lower prize value 22 which is a minimum value for the prize value, and which is displayed to the gainers if the accumulated amount is being incremented downwardly. The upper and lower prize values define a range for the prizes in a given level. This will be described further below.

It will also be appreciated that device 2 stores data indicative of current prize values 10 and values 11.

Motherboard 9 includes a communications bus 25 for accommodating the communication between the various computing components shown.

It will be appreciated that the figures are highly schematic and intended to provide the skilled addressee with an understanding of the features and functionality provided by apparatus 1 and the interaction between the components illustrated. It would be understood from the teaching herein that those functionalities and interactions are able to be implemented in other ways. For example, for the purposes of clarity, the functionality of processor 15 is, in this embodiment, separated from that of processor 8. However, in practice, the functions of one or more of processors 8, 15 and 17 are able to be performed by a single processor or by a combination of processors.

Card 4 is a dedicated hardware device that is linked to bus 25 by an external communications bus 26. Both these buses are schematic representations of a plurality of digital lines. In some embodiments, bus 26 includes one or more analogue lines—for video and audio—in addition to the digital lines.

As shown in FIG. 1, terminals 6 are respective gaming machines that are co-located in a single gaming establishment 27. While only four terminals are shown, it is usual to have many more than this—from ten to many hundreds—linked by apparatus 1. Where it is desired to link greater numbers of terminals use is made of a structured network of apparatus 1. To this end, apparatus 1 includes a network card or communications card 28, as shown in FIG. 2. In some embodiments, card 28 is configured for wireless communication.

Terminals 6 are typically physically arranged in groups or lines and are presented to make them easily accessible for garners and to contribute to the social event engaged in by the garners. Each terminal includes a dedicated interface card (not shown) to provide and receive predetermined communications signals to a 10 Mbits/s Cat 5 communications bus 29. In other embodiments use is made of an existing network, such as CMS, to affect the required communications. In other embodiments use is made of an alternative network or networks.

Bus 29 is also linked to card 4 for allowing apparatus 1 to communicate with terminals 6. It will be appreciated that terminals 6 in this embodiment do not communicate with each other, but only with apparatus 1. However, the communication between each terminal and apparatus 1 is two-way. In other embodiments the communication between the terminals 6 and apparatus 1 is one-way. This is often due to legislative requirements in the jurisdiction in which the embodiment is implemented.

In practice, apparatus 1 is located away from terminals 6 and in a location that is easily accessible by technical staff of the establishment. For example, in some embodiments, apparatus 1 takes the form of a networked server and is located together with other servers and computer equipment in a dedicated room within the establishment. More preferably, the location makes the networked server secure against physical tampering, and use is made of appropriate software barriers and tools to prevent unauthorised electronic access to the server.

As best shown in FIG. 2, apparatus 1 includes a display driver in the form of a video card 31 for providing a video output signal that contains information indicative of the accumulated values. In some embodiments, the video output signal includes data indicative of one or more of the upper prize value and the lower prize value. For example, in instances where the accumulating values are being incremented by processor 8 toward the upper prize value, the video signal includes data indicative of the upper prize values such that the gamers using terminals 6 will have that information displayed to them. However, in other embodiments information indicative of the both the upper and lower prize values is included in the video signal and other cues are used to provide the gamer with an indication of which of those values is of greater relevance at any given time.

Card 31 is provided command signals and data signals by processor 8 via bus 25 and 26. These signals are processed by the circuitry and software available on the card to provide the output signal that is, in this embodiment, propagated via a video and audio cable 32. In some embodiments the command signals and data signals are combined.

Cable 32 provides a video feed for a dual screen video display 33 which includes audio reproduction devices in the form of an audio amplifier 34 and a plurality of spaced apart speakers 35. In this embodiment, display 33 includes two large LED displays 36 that are prominently located within establishment 27 near terminals 6. For larger establishments with a greater number of terminals, or where the terminals are for other reasons spatially dispersed, display 33 includes a plurality of spaced apart LED displays or other displays for best providing all the garners of terminals 6 with the desired information about the progress of the central jackpot game in which they are participating. While the central jackpot game is referred to in the singular, it will be appreciated that this game includes, at least at some times, a plurality of prizes that are simultaneously on offer. In effect, the single jackpot game is providing the garners with a plurality of additional games.

The location of the LED displays within establishment 27 is intended to allow the gamers utilising terminals 6 to easily determine the quantum of the accumulating value or values. In this embodiment, display 33 also provides the garners with a visual indication of the upper prize value and the lower prize value, and whether the accumulating value is incrementing upwardly or downwardly. In those embodiments where more than one prize is available simultaneously to be awarded—for example, where different levels of prizes are used—display 33 is able to display all the relevant accumulated values, upper prize values and lower prize values.

In other embodiments, displays 36 are substituted with one or more spaced apart plasma screens, video projectors, television monitors, CRT projectors or other display devices. The use of spaced apart display devices is particularly advantageous where there are many terminals 6 within the establishment, or where those terminals 6 are distributed widely within the establishment. For those embodiments where terminals 6 are not all in the same establishment, then provision is made for separate displays in the separate establishments.

The use of display 33 is advantageous as it provides information to the gainers and allows them to derive more entertainment and enjoyment for a given wager. It is also advantageous to have display 33 as a separate component that is prominently located, as that provides open information to potential gainers as to extra benefits of terminals 6 over prior art terminals.

In other embodiments, a separate display 33 is not used. That is, the visual indication is provided as a digital signal via bus 29 directly to terminals 6. In turn, this signal is received by the respective interface cards in the terminals and displayed on the screens of the terminals. This is particularly advantageous for those embodiments where not all terminals 6 are located at within the across at least two different establishments.

In further embodiments use is made of both a separate display 33 and a display on each of the individual terminals.

Figure 3:
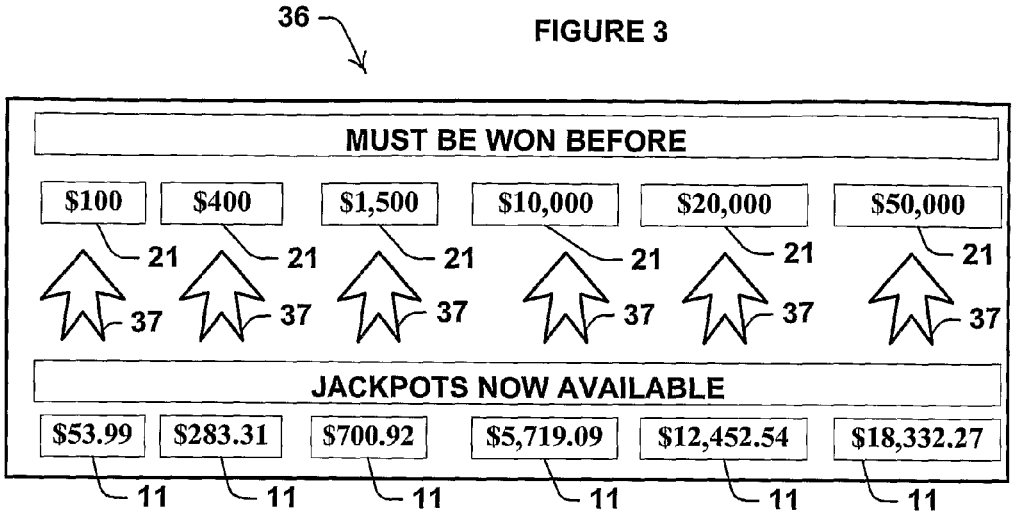
FIG. 3 is a schematic view of a display that is driven by the apparatus of FIG. 2.

Referring to FIG. 3 there is diagrammatically illustrated the information provided to garners by one of displays 36. This includes six accumulating values 11—where, in this instance, $AV_1, AV_2, \ldots, AV_6$ are \$53.99, \$283.31, \$700.92, \$5,719.09, \$12,452.54 and \$18,332.27 respectively. As all the values 11 are being incremented toward the respective upper prize values 21, those upper prize values are also displayed to the gamers, as too are six upwardly directed arrows 37 that are used to assist garners cognise the relationship between values 11 and values 21. As illustrated, the respective upper prize values 21 are \$100.00, \$400.00, \$1,500.00, \$10,000.00, \$20,000.00 and \$50,000.00. In other embodiments alternative upper prize values are used, or alternative information is displayed to the gamers. For example, when an accumulating value 11 is being incremented toward the respective lower prize value 22 the respective arrow 37 will be downwardly directed. If all the values 11 are being incremented downwardly then values 22 are illustrated in display 36 below values 11.

Apparatus 1 includes a payout device in the form of a payout circuit 39 on board 9, which is responsive to the increment signal and the award signal for selecting the terminal to which the prize is awarded. It will be appreciated that each terminal 6 includes data indicative of a gaming balance that is available to the gamer using that terminal. Circuit 39, upon selecting the terminal, credits the respective gaming balance. In this embodiment circuit 39 credits the gaming balance by the accumulating value. In other embodiments the gaming balance is credited by a different amount. In those embodiments where each terminal 6 has an SEI card, as is the case with the present embodiment, it is possible to transfer and store the funds awarded to the SEI card of the respective terminal. This then facilitates a tertiary game for the gamer in that the awarded funds are able to be wagered as part of a tertiary game. That is, only those terminals 6 with stored values of awarded funds from the secondary game will be able to participate in the tertiary game, and only with those awarded funds or additional funds won in the tertiary game. One example of a tertiary game is a simple "double up" game that allows the gamer the choice of wagering the amount awarded from the secondary game, with a 50% chance of doubling the value of the awarded funds, and a 50% chance of loosing the awarded funds. Once the tertiary game is completed any remaining funds are transferred to the gaming terminal. In other embodiment, however, the gamer has to provide a positive affirmation that the funds are to be transferred. Furthermore, once the gamer has decided to cease the gaming session, any credit balance on terminal 6 is able to be redeemed in the usual manner. This includes, by way of example, a cash payout from the terminal, a ticket printed by the terminal, the update of the gamer's smartcard by the terminal, or the gamer seeking the payment from a cashier or other centralised payment point. If the credit balance is large, the most practical ways of affecting a redemption requested by the gamer is to:

1. Affect a manual payment.
2. Transfer the value to the player's terminal.
3. If available, print a ticket using a ticket printing device located at the terminal.
4. Credit the player's credit card or online wallet.
5. Transfer the balance to a mobile device with technology for allowing such a transfer—such as, but not limited to, a cellular telephone, a PDA, or a mobile computer—for redemption at a later time.

Related patent applications for this technology include PCT patent application no. PCT/AU2005/000615 and PCT/AU2006/001530, the subject matter of which is incorporated herein by way of cross-reference.

Figure 4:
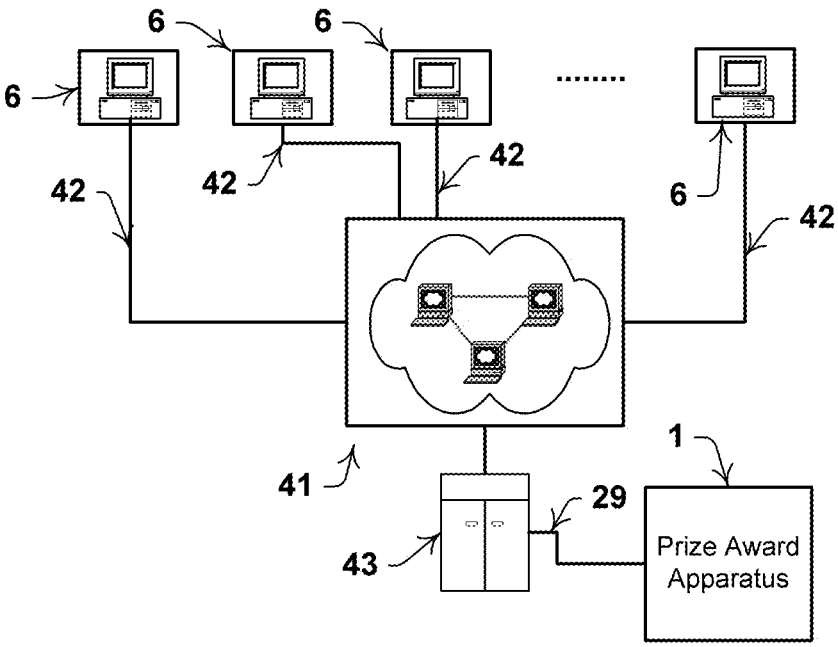
FIG. 4 is a schematic view of an online gaming network including an apparatus according to the invention.

In other embodiments, such as that shown in FIG. 4, terminals 6 are computer devices such as stand alone desktop computers that are remotely located. In this embodiment, each computer is at the residence of the respective garners. The computers are each linked to the internet 41 via respective telephone lines 42. Apparatus 1, on the other hand, is linked to an internet server 43 via bus 29. In other embodiments the computers are linked to the internet other than by telephone lines. For example, in some embodiments, use is made of wireless links, cable connections or other available links.

Server 43 allows communication between terminals 6 and apparatus 1 to provide the same functionality as that achieved by the FIG. 1 embodiment. However, in this case, the delivery of the information is browser based.

In some embodiments, apparatus 1 communicates both with terminals that are gaining machines and terminals that are remotely located desktop computers.

It will be appreciated by those skilled in the art, from the teaching herein, that server 43 will also allow the invention to be performed with terminals that are laptop computers, mini-computers, PDA's and other computing devices with internet, 3G or WAP capability. Moreover, in some embodiments, server 43 is able to interact with gamers by way of the cellular telephone network.

Reference is specifically to FIG. 1 and FIG. 2. In use, the garners operating terminals 6 are participating in a game of chance that is contingent upon the predetermined virtual spacing on a screen of the respective gaming terminals of a number of icons. Once the gamer establishes a credit balance with the terminal, by one of various means, it is possible for the gamer to initiate a gaming sequence. After the sequence has played out, and the result displayed on the screen of the terminal, the terminal then provides a respective input signal 5 on bus 29 via a further SEI card (not shown).

Signal 5, in this embodiment, includes a multi-bit string of information having a unique identifier for the terminal, the quantum of the wager placed upon the gaming sequence that was completed, and the percentage or part of that wager that is to be used by apparatus 1. This percentage or part of the wager is referred to as "the contribution" by the relevant terminal, and may be either expressed as a percentage or as an absolute monetary amount.

When respective garners are simultaneously playing the terminals, a stream of input signals are provided by the respective SEI cards and received by card 4. This stream of signals is grouped in batches taken over a polling period. A typical polling period has a duration of less than one second and in some embodiments about 300 milliseconds. However, in other embodiments the polling period is greater than one second. In this specific embodiment each polling period has the same duration, that being 1.5 seconds. In some embodiments different polling periods have different durations. The duration of the polling period is ideally short to provide as close as possible to real time processing of the input signals and incrementing of the accumulating values and the award of any prizes. This better ensures that if a prize is to be awarded that the terminal to which it is to be awarded is still being operated by the same person who gave rise to the input signal in the polling period in which the prize was awarded. A short polling period also provides a sufficiently regular update of the displayed accumulating values for the gamers to perceive what is seemingly constant change. However, due to delays in obtaining input signals, particularly for larger venues, and processing time, it is not always possible to contain the polling period to less than 1.5 seconds. In some embodiments the incrementing of values 11 occurs more or less frequently than every polling period although preferably the determination of the award of the prize takes place at least each polling period. In the embodiments described in this specification only the values 11 and one or more of the upper and lower values are displayed to gamers. In other embodiments additional information is displayed to the garners including, for example, one or more monetary values corresponding to prize values that have been awarded recently.

In addition to the individual games of chance, the garners are also participating in additional group games of chance, in that they are eligible to win one or more of the "jackpot" amounts. The two games—that is, on the one hand, the primary games on respective terminals 6 and on, the other, the secondary or jackpot game provided by apparatus 1—are independently operated in that the probability of a gamer winning one of the games does not affect their probability of winning the other except insofar as the amount contributed to winning the jackpot amount is contingent upon the quantum of the wager for the individual game of chance being played on the respective gaming terminals. In this embodiment, the secondary game includes a set of prizes to be awarded where the prize values for those prizes are randomly selected to fall between the respective lower prize values and upper prize values. The prizes are successively awarded until such time as there are no further prizes in the set to be awarded. Accordingly, during the award of the prizes there will be successively fewer prizes to be awarded until there are none. After that, apparatus 1 selects a further set of prizes and repeats the steps to determine the award of the prizes in that further set.

As mentioned above, device 2 includes data indicative of the prize values as well as, for each level, the upper prize value and the lower prize value. The upper prize value for a level is the maximum possible value of the prize to be awarded at that level, while the minimum prize value is the minimum possible value of the prize to be awarded for that level. Device 2 holds the data indicative of the prize values in a data structure such as a data table which includes a plurality of tables having column headers that are discussed further below. In other embodiments additional, substituted or alternative column headers are used. While all of the data in the following table is stored within device 2 all the records in that table are not illustrated in FIG. 5 for the sake of clarity.

In other embodiments, card 4 is a network card designed to retrieve the appropriate information from a plurality of gaming devices, whether those devices be stand alone gaming machines, personal computers running gaming software, lottery terminals, or the like.

In this specification use is made of the term Electronic Gaming Machine (EGM) to refer to a gaming machine, where these types of machines are also known as poker machines or slot machines. The FIG. 2 embodiment is specifically developed for use with a plurality of EGMs that are linked by a computer network having a communication protocol to allow the participation of the gamers of the EGMs in a linked jackpot game, which is otherwise referred to as a secondary game or a common game. This common game is provided by an operator of apparatus 1 in addition to the primary game that the garners are playing on respective EGMs. Each terminal includes a further SEI card (not shown) for linking the terminal to the network and for allowing communication between the terminals and apparatus 1 via card 4.

In the FIG. 1 embodiment the EGMs are co-located within a common room or gaming establishment and are linked by a LAN maintained by an operator of the establishment. While in this specific embodiment the operator of the establishment is different to the operator of apparatus 1, in other embodiments there is a common operator. Moreover, in other embodiments, the EGMs are more geographically dispersed, and are linked by a WAN or other network that is maintained or owned by more than one operator and/or other parties.

It will also be appreciated that the network communications between nodes within any network—that is, any nodes within the WAN, LAN or other network—is preferably achieved primarily with physical cabling. In other embodiments, however, use is made of wireless communication paths either in combination with or as an alternative to the cabling.

Storage device 2 includes one or more of the following elements:

A hard disk drive.

RAM.

ROM.

A CD/DVD drive for selectively containing a CD/DVD.

The data required to operate apparatus 1 is selectively stored in one or more of the above elements. In addition, it will be appreciated that all of processors 8, 15 and 17 will include some onboard cache that is also able, if and when required, to contain some or all of the data.

The terminology of "level" or "levels" arises from the often large differences between the prize values attributable to the prizes to be awarded in the different jackpot games that are progressing in parallel. It would not be unusual for the differences between prize values awarded in adjacent levels to be an order of magnitude. That is, for each level the ranges defined by the respective pairs of lower prize value and the upper prize value are very different, and usually these ranges do not overlap. In the following example only the fifth and sixth levels have ranges that overlap. However, in other embodiments there is an overlap between the ranges of other levels.

Use is made of a plurality of levels to:

Providing garners with variety, in that there are many prize values likely to be awarded at any given time.

Provide a spread of prizes of significantly different value to accommodate garners who are sceptical about ever winning a larger jackpot.

Provide operators with some certainty about the quantum of the prize values to be awarded to better allow control of player return rates and costs.

While some aspects of the data stored in device 2 is set out above, it will be appreciated that this is typically a subset of the total data stored. For example, in the embodiment being described device 2 stores a data table having the following columns:

| Column Header | General Description |
|---|---|
| Prize Number | A unique integer or string for each prize in the table. Preferably the integer or string is unique for all prizes to be awarded by the embodiment. |
| Level Number | A unique integer or string to identify the level that each prize value has been assigned. In some embodiments each level includes only a single prize, while in other embodiments a level may include more than one prize. |
| Prize Value | A value for each prize, typically a financial value expressed in a currency used in the jurisdiction. In other embodiments, however, the value is expressed in non-financial units or symbols. A sub-set of these other embodiments later converts the units or symbols to a currency. In this embodiments the prize values are referred to as In this specific embodiment use is made of $PV_1, \ldots, PV_y$, where $y > 1$. |
| Write Time | The time the prize was written to the table. Expressed as accurately as allowed by the timing software used. |
| Prize Award Flag | This flag applies to each prize, and is set to indicate that the respective prize has been awarded. That is, this field in this column of the data table is indicative of whether the current prize value has been defined by the respective prize values and awarded. |
| Award Time | The time the prize was awarded. Expressed as accurately as allowed by the timing software used. Prior to a prize being awarded, this field in the table - for that specific prize - has a null value. |
| Award EGM | Indicative of the EGM that is determined to have provided the input signal resulting in the award of the current prize. |
| Upper Prize Value | A financial value that indicates for a given level the maximum value of prize able to be awarded. This is typically set by the operator of the gaming venue or venues in which the EGMs are disposed and is usually displayed or otherwise made known to the gamers. |
| Lower Prize Value | A financial value that indicates for a given level the minimum value of prize able to be awarded. This is typically set by the operator of the gaming venue or venues in which the EGMs are disposed and is usually displayed or otherwise made known to the gamers. |
| Weighting | A weighting is included for each prize, and these are indicative of the relative amount of the available increment that is to be applied to the accumulated value for the respective prizes. The default value is typically zero - that is, in the absence of the weighting being refreshed to other than zero there will be no increment of the respective accumulated value for the prize. |

In other embodiments alternative or additional columns are included in the data table.

In this specific embodiment there are six prizes with respective prize values and six levels, as set out in the table below.

| Level No. (m) | Lower Prize Value | Upper Prize Value | Prize No. (n) | Prize Value |
|---|---|---|---|---|
| 1 | $50 | $100 | 1 | $56.98 |
| 2 | $200 | $400 | 2 | $324.80 |
| 3 | $500 | $1,500 | 3 | $1,302.33 |
| 4 | $5,000 | $10,000 | 4 | $7,008.92 |
| 5 | $10,000 | $20,000 | 5 | $15,392.76 |
| 6 | $15,000 | $50,000 | 6 | $19,477.08 |

It will be appreciated that in other embodiments:

A different number of levels are included. That is, in other embodiments, $m \neq 6$. However, in the embodiments of the invention it is always true that $m \geq 2$.

There are included a different number of prizes. That is, in these other embodiments, $n \neq 6$.

The number of levels is not equal to the number of prizes initially available to be awarded. That is, in these other embodiments, $n \neq m$. If so, it is also usual that there are more prizes than levels, in that $n > m$.

In summary, in the embodiments of the invention, there are initially at least two levels and at least one prize for each level. That is, usually $n \geq m \geq 2$.

The levels represent respective jackpot prizes that are presently available to be awarded to garners. In the above example there is one prize in each level, and all six levels are simultaneously available to be awarded, in that the six jackpot games progress in parallel. Where the number of prizes is greater than the number of levels there are still a plurality of prizes available simultaneously to be awarded, where the plurality corresponds to the number of levels.

As the prizes are successively awarded there will be a point where the number of prizes remaining to be awarded is less than the number of levels that were initially available. Once that occurs, for the present embodiment, there will be one level where there is no prize to be awarded, and five levels still having respective prizes to be awarded and which are available simultaneously to be awarded. Following the award of the next prize, there will be two levels where there is no prize to be awarded, and four levels still having respective prizes to be awarded and which are available simultaneously to be awarded. This will continue until, ultimately, there will be no levels with prizes to be awarded. At this point a new set of prizes is selected or determined—typically with a random component—and the cycle of determining the award of prizes recommences with a plurality of prizes being on offer simultaneously.

While in the above embodiment there are provided six levels, other embodiments use more or less levels. In most venues the preferred number of levels is between two and six, and more preferably three or four. However, where there is a need for more than six levels apparatus 1 is configured accordingly.

Figure 6:
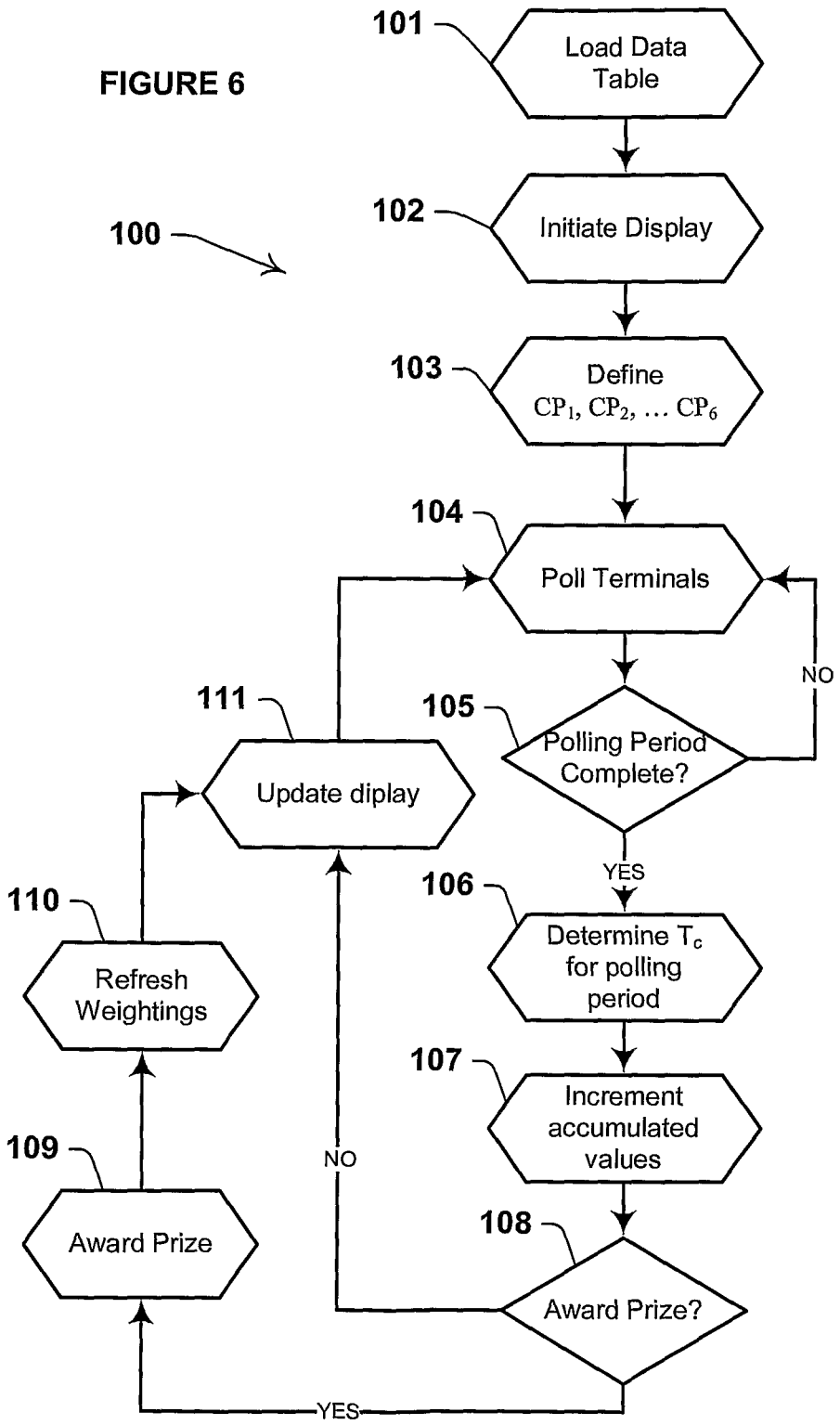
FIG. 6 is a flow chart illustrating the operation of the apparatus of FIG. 1.
Figure 7:
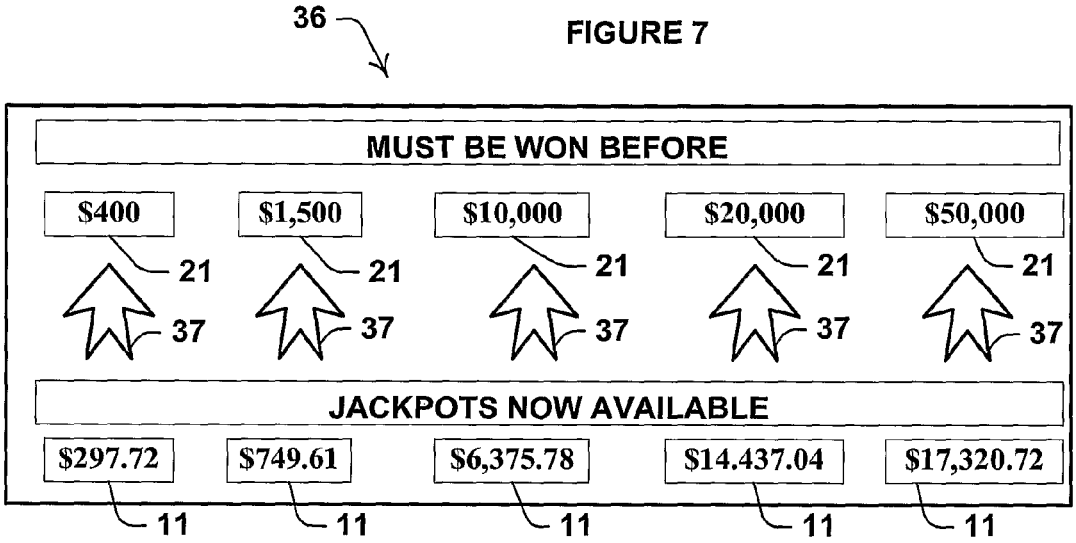
FIG. 7 is a schematic view of a display as driven at start-up by the apparatus of FIG. 2.

The operation of apparatus 1 will now be described, by way of example only, with reference to FIG. 6 and flowchart 100. At start-up, and as schematically illustrated in FIG. 5 at step 101, processor 17 is programmed by code held in memory device 2, on board cache, or other memory, to load the data table and any other required information into device 2. Processor 17 sets, as a default, the accumulated values $AV_1, AV_2, \ldots, AV_6$ to one of the upper prize value or the lower prize value for each level, and at step 102 controls card 4 to ensure that these default accumulated values are visually displayed by display 36. This visual display at start-up is best illustrated in FIG. 7, and in particular by accumulated values 11 designated in that Figure. It will be appreciated that values 11 are displayed as being the value of the jackpots that are presently available to be awarded to a gamer. In this embodiment at start-up there are six jackpots available, in that at start-up the number of prizes (n) equals the number of accumulated values (x) and the number of levels (m). In other embodiments at start-up the number of accumulated values, while equalling the number of levels, is less than the number of prizes.

For this embodiment the default values 11 are the lower prize value for each of the levels. Accordingly, as the garners operate terminals 6 the values 11 are incremented toward the respective upper prize values 21, where values 21 are also displayed to the gainers by display 36.

In other embodiments one or more of the default accumulated values is randomly selected to lie between the upper and lower value. In further embodiments one or more of the default accumulated value is predetermined. In additional embodiments the basis of the selection of the default values changes between successive selections of the default value.

In this embodiment the prize values are predetermined and included within the data table that is loaded at step 101. In other embodiments, however, the determination of these values is left to apparatus 1. Where that occurs, the determination preferably includes a selection of prize values having a random component. For example, in some embodiments, the selection is random, but normalised to fall within the bounds of the respective pairs of upper and lower values. In those embodiments having more than one prize in a given level, the prize values are preferably derived to provide a distribution between the upper and lower prize values for that level to satisfy one or more of:

A desired distribution—random or otherwise—across the range defined by the upper and lower prize values.

A desired average prize value.

A desired number of prize values.

The distribution, relative size and other characteristics of these values are often set by an operator of apparatus 1. This operator in this embodiment is different to the operator of the gaming venue and the EGMs. However, in other embodiments, both operators are the same party.

While in this embodiment all the prize values for the prizes are predetermined prior to any prize having been awarded and prior to the prize values 11 being loaded into device 2, in other embodiments the quantum of each prize value is not determined until that prize value is selected to define the current prize value for a given level. That is, in some embodiments the prize values are not determined until the prize has been selected to be the next awarded prize for a given level. In further embodiments at least one of the prize values is predetermined, and the remainder are determined only when selected to define respective current prize values.

The operator of the gaming establishment (also known as a gaming venue) is able to set the upper and lower values for one or more of the levels in accordance with the desired mix of prize values, and the desired size of maximum and minimum prize values to be awarded to garners. This in turn is based upon a number of factors such as the average value of the wagers regularly made at the venue, the turnover at the venue, the time of day, the percentage of the wager made at the EGMs that is indicated by the input signal as being contributed to the accumulated value, and others.

In response to any change by the venue operator of the upper and lower values from the default values there is a scaling of all the prize values to substantively retain the desired distribution of prize values between the upper and lower values. It will be appreciated that some rounding of prize values does occur during this operation to account for the number of decimal places being used determining the awarded prize amount.

In other embodiments the prize values are all predetermined and any adjustment by the venue operator of the upper and lower values has no effect on the prize values.

The FIG. 5 flow chart also indicates that processor 8 is responsive to records 3 stored in device 2 for defining at step 103 the six current prize values $CP_1, CP_2, \ldots CP_6$ as the six prize values referred to in the above table. For those embodiments where there are more prizes than levels there is a need to select for each level a prize from the available prizes for each level. Typically, this occurs randomly.

It will be appreciated that while one or both of the upper and lower prize values are in some embodiments displayed—typically via display 36—or otherwise communicated to the garners, the current prize values are not revealed to ensure the garners are provided with an additional entertainment and game of chance and to reduce the risk of fraudulent misuse of apparatus 1.

As the garners operate terminals 6 respective input signals 5 are provided to card 4. These signals 5 are batched for successive polling periods and at step 106 a total contribution $T_c$ for that polling period is calculated. In some embodiments $T_c$ is a fixed amount per wager for each signal 5. However, more usually, $T_c$ is in proportion of the quantum of each wager indicated in the signals 5 included within a given batch. The latter approach allows the gamer wagering larger amounts to have a greater chance the current prize being awarded in a giving polling period as ultimately the accumulated amounts will be incremented by a greater amount. The proportion of the wager to be included within $T_c$ is usually agreed upon between the operator of apparatus 1 and the operator of the gaming establishment. In some embodiments the proportion is also determined, at least in part, by the respective gamers.

In this embodiment data indicative of $T_c$ is included within signal 7. Processor 8, at step 107, is responsive to signal 7 and weightings $W_1, W_2, \ldots, W_6$ for selectively incrementing in parallel toward the current prize values 10 respective accumulated values $AV_1, AV_2, \ldots, AV6$. In particular, processor 8 is responsive to weightings $W_1, W_2, \ldots, W_6$ for determining how to allocate $T_c$ between the available values $AV_1, AV_2, \ldots, AV_6$. If a prize value is to define a current prize value, then the weighting is non-zero to ensure that the respective accumulated value will increment for each polling period up until the prize has been awarded. For once a prize is awarded for a given polling period, the weighting for that prize for subsequent polling periods is set to zero. In some embodiments the weighting for one or more of the prizes are set to zero prior to the respective prize being awarded, but only until other predetermined conditions are met, and then set to other than zero so that the respective accumulated value will continue to increment. For example, in some embodiments the weighting for a given prize is refreshed to be non-zero for one or more polling periods, and then for a number of subsequent polling periods is refreshed to be zero until such time as one of the other accumulated values has incremented beyond a certain value. This more usually takes the form of the accumulated value for a lower level being halted, or slowed, so that the accumulated value for a higher level is able to be more rapidly advanced. In other words, the weightings are able to be refreshed and changed to control the allocation of $T_c$ and, hence, the increments to the accumulation values, for different polling periods.

In this embodiment, the weightings are zero once the respective prizes are awarded, and otherwise a fixed value. The fixed value is calculated as the average of the lower prize value and the upper prize value for each prize. On the basis of the specific example provided above, the $W_1, W_2, \ldots, W_6$ are respectively 75, 300, 1,000, 7,500, 15,000 and 32,500. However, in other embodiments the weightings are calculated differently.

In other embodiments card 4 is responsive to $T_c$ and the weightings for determining the increment to be applied to the accumulated values. Card 4 includes data indicative of any determination within signal 7 for use by processor 8.

With the accumulated values having been incremented as described above, processor 15 is responsive to values 10 and values 11 for determining at step 108 if one or more of the current prize values 10 are to be awarded. This determination includes comparing for the polling period under consideration and the immediately preceding polling period the difference between the accumulated value and the current prize value for each current prize value. If the sign of the difference changes between the two polling periods, the respective current prize value is to be awarded as a result of activity during the polling period under consideration. If the sign of the difference remains the same between polling periods the respective prize is not to be awarded for activity during the polling period under consideration.

If a prize is not awarded for a given polling period apparatus 1 at step 109 updates display 36 with the incremented accumulated values $AV_1, AV_2, \ldots, AV_6$ and returns to step 104 to again poll terminals 6 for the next polling period.

If one or more of the prizes are to be awarded for activity in the polling period, processor 15 generates the award signal 16 and, at step 109, the prize is awarded to the one of terminals 6 that provided one of signals 5 to card 4 during the polling period under consideration. At step 110, processor 17 is responsive to signal 16 for selectively refreshing records 3, where that refreshing is, in this embodiment, limited to changing the weightings such that the weighting for the prize or prize that was awarded for the polling period under consideration is set to zero. It will be appreciated that by setting the weighting to zero for an awarded prize will result in processor 8 not incrementing for any subsequent polling period the accumulated value 10 associated with the awarded prize.

In other embodiments the refreshing of records 3 includes one or more of:

- Changing one or more of the weightings $W_1, W_2, \ldots, W_6$.
- Changing one or more of the prize values $PV_1, PV_2, \ldots, PV_6$.
- Changing one or more of the upper prize values or lower prize values for one or more of the prizes or the prize levels.

In other embodiments the weightings are able to be selectively changed to a value other than zero. For example, in some embodiments the operator is able to apply for a given time—for example, for twenty consecutive prize periods—a greater relative weighting to one or more of the prizes. This increased rate of accumulation of the respective accumulated value is usually accompanied by a message on display 36 to inform the gamers of the transient condition. In some embodiments the weightings are sequentially varied over such periods such that the accumulated values for the prizes, rather than increasing at relatively constant rates in parallel, increase in sporadic rates in sequence.

The third action mentioned above allows, for a given polling period, movement of one or more of an accumulated value or one of the upper or lower values. For example, if the accumulated value is being incremented upwardly toward the respective current value—and hence toward the upper prize value—it is possible to change the value of the upper prize value to add an additional variable for the garners to enjoy. For example, if it was chosen to increment the upper prize value toward the current prize value, and as a result it fell below the current prize value, the current prize value would be awarded.

With the weightings refreshed display 36 is updated at step 111 to include the new accumulated values 11. If none of the prizes are awarded then display 36 includes all six slightly greater accumulated values 11, where the increase is in proportion to the weighting. Taking, by way of example, the instance where prize no. 1 is awarded, display 36 will provide a visual indication of this fact and a predetermined musical piece or sample will be reproduced via amplifier 34 and speakers 35. In this embodiment the musical sample differs for prizes at each different level. Accordingly, with experience the gamers become familiar with the respective samples. The weighting for prize no. 1 is then refreshed, in that it is set to zero and display 36 updated to indicate the information shown in FIG. 7, where corresponding features are denoted by corresponding reference numerals. It will be appreciate that display 36 now makes no reference to prize no. 1, but that the as yet un-awarded prizes no. 2 through to 6, continue to be displayed and with increased respective accumulated values 11. In other embodiments, when a prize is awarded the awarded value continues to be displayed to the gamers by display 36, but is rendered in a different colour and/or font and/or other format to readily distinguish it from the other prizes that are yet to be awarded. For example, in one specific embodiment, the value of an awarded prize remains statically rendered, but in a shade of red, while the accumulating values for the other levels are flashing and rendered in a shade of green.

Steps 104 to 107 are then repeated and if the refreshed weightings have changed from the immediately preceding polling period the proportion of $T_c$ incremented to the individual accumulated values will also change. Typically also, $T_c$ changes between polling periods due to the different contribution arising from the wagers indicated by the respective signals 5 received during the polling period.

In this particular instance of prize no. 1 having been awarded, there now remain only five prizes across which to divide $T_c$. Accordingly, the relative rate of progress of the accumulated values $AV_2, AV_3, \ldots, AV_6$ will be greater than would have been the case if some of the contribution had to still go to a prize at level no. 1. And as additional prizes are awarded the proportion of $T_c$ that is allocated to the remaining prizes will continue to increase. This provides to the garners a cascading effect of prizes, in that once a prize is awarded it will hasten the award of other of the prizes. This is distinct from the prior art levels where the award of a prize at a given level simply meant that another prize was selected to be next awarded at that level. In this embodiment all the prizes are awarded before a new set of prizes—one for each level—is awarded.

In other embodiments the weightings are refreshed to initially make available for award a predetermined number of prizes—other than zero—and then to increase that number between polling periods. Preferably the trigger for changing the number of available prizes is the award of a presently available prize. However, in other embodiments the trigger is to institute change in the next polling period.

The prizes are arranged in sets of prizes that are all awarded prior to a new set of prizes being selected and similarly awarded. It will be appreciated by those skilled in the art that the changing of a weighting for a prize to zero after the award of the prize is equivalent to removing the prize from the set. Accordingly, apparatus 1 is able to be also described as broadly in the as including:

memory for storing prize data indicative of the prize values in the set;

an input device being responsive to input signals from a respective plurality of gaming terminals for providing an increment signal;

an increment device for: accessing the prize data to select at least two prize values from the set to define respective current prize values; and being responsive to the increment signal for incrementing in parallel a plurality of accumulated values toward the respective current prize values; and a comparator being responsive to the current prize values and the accumulated values for determining if one of the current prize values is to be awarded and, if so, generating an award signal and removing from the set the prize value corresponding to the one of the current prize values.

In those embodiments where the weighting change apparatus 1 is able to be broadly described as including:

memory for storing data indicative of the prize values and the weightings;

an input device being responsive to input signals from a respective plurality of gaming terminals for providing an increment signal;

an increment device that is responsive to: the prize values for defining respective current prize values; and the increment signal and the weightings for selectively incrementing in parallel toward the current prize values respective accumulated values;

a comparator being responsive to the current prize values and the accumulated values for determining if one or more of the current prize values are to be awarded and, if so, generating an award signal; and a processor that for selectively refreshing the data to change the weightings.

In the described embodiments of the invention the weightings are either zero or greater than zero. In some embodiments use is made of negative weightings, for example, to indicate that the accumulated value for a given prize is progressing toward the lower prize value.

In other embodiments, the weightings for the prizes do not change but, rather, device 2 contains data indicative of respective accumulation states for each prize. An accumulation state is a flag for a prize that, when set, indicates the prize is available to be awarded—that is, the prize value for that prize defines a current prize value—and that the accumulated value for the prize is to be incremented for that polling period. When operating in this way, apparatus 1 is able to be broadly described as including:

memory for storing data indicative of the prize values and the accumulation states;

an input device being responsive to input signals from a respective plurality of gaming terminals for providing an increment signal;

an increment device that is responsive to: the prize values for defining respective current prize values; and the increment signal and the accumulation state for selectively incrementing in parallel toward the current prize values respective accumulated values;

a comparator being responsive to the current prize values and the accumulated values for determining if one or more of the current prize values are to be awarded and, if so, generating an award signal; and a processor that is responsive to the award signal for selectively refreshing the accumulation states such that the increment device does not increment the accumulated values associated with the one or more of the current prize values.

With prior art systems—where typically there is always one prize available in each level—the gamer is more likely to lose interest once a prize has been awarded at any given level. The preferred embodiments of the invention allow this disadvantage to be overcome by offering a cycle of changing numbers of levels in which prizes are simultaneously available to be awarded. While usually the number of levels diminishes with the award of prizes, in other embodiments the number of levels:

Remains constant for the award of one or more prizes and then progressively diminishes.

Increases to up to a predetermined maximum number.

Increases and decreases randomly or in a predetermined sequence.

A significant advantage of the preferred embodiments is that the interest of the gamer is maintained due not only to the multitude of jackpot values, but also due to the variation in the number of the available jackpot values and the change in rate of change of the accumulated values due to the changing proportion of $T_c$ that is applied. This is particularly significant in smaller venues with lower values of $T_c$, or in those venues with considerably different values of $T_c$ at different periods in day. The use of the embodiments of the invention allows rates of change of accumulated values to be tailored while still ensuring "return to player" percentages are maintained and the costs of operating apparatus 1 are contained.

Unless specifically stated otherwise, as apparent from the following discussions, it is appreciated that throughout the specification discussions utilizing terms such as "processing", "processing system", "computing", "calculating", "determining", "analysing" or the like, refer to the action and/or processes of a computer or computing system, or similar electronic computing device, that manipulate and/or transform data represented as physical, such as electronic, quantities into other data similarly represented as physical quantities.

In a similar manner, the term "processor" may refer to any device or portion of a device that processes electronic data, for example, from registers and/or memory to transform that electronic data into other electronic data that, for example, may be stored in registers and/or memory. A "computer" or a "computing machine" or a "computing platform" may include one or more processors.

The methodologies described herein are, in one embodiment, performable by one or more processors that accept computer-readable (also called machine-readable) code containing a set of instructions that when executed by one or more of the processors carry out at least one of the methods described herein. Any processor capable of executing a set of instructions (sequential or otherwise) that specify actions to be taken are included. Thus, one example is a typical processing system that includes one or more processors. Each processor may include one or more of a CPU, a graphics processing unit, and a programmable DSP unit. The processing system further may include a memory subsystem including main RAM and/or a static RAM, and/or ROM. A bus subsystem may be included for communicating between the components. The processing system farther may be a distributed processing system with processors coupled by a network. If the processing system requires a display, such a display may be included, for example, a liquid crystal display (LCD) or a cathode ray tube (CRT) display. If manual data entry is required, the processing system also includes an input device such as one or more of an alphanumeric input unit such as a keyboard, a pointing control device such as a mouse, and so forth. The term "memory unit" or "memory" as used herein, if clear from the context and unless explicitly stated otherwise, also encompasses a storage system such as a disk drive unit. The processing system in some configurations may include a sound output device, and a network interface device, for example. The memory subsystem thus includes a computer-readable carrier medium that carries computer-readable code (for example, software) including a set of instructions to cause performing, when executed by one or more processors, one of more of the methods described herein. Note that when the method includes several elements, for example, several steps, no ordering of such elements is implied, unless specifically stated. The software may reside in the hard disk, or may also reside, completely or at least partially, within the RAM and/or within the processor during execution thereof by the computer system. Thus, the memory and the processor also constitute computer-readable carrier medium carrying computer-readable code.

Furthermore, a computer-readable carrier medium may form, or be includes in a computer program product.

In alternative embodiments, the one or more processors operate as a standalone device or may be connected, for example, by being networked to another processor or other processors. In such a networked deployment, the one or more processors may operate in the capacity of a server or a user machine in a server-user network environment, or as a peer machine in a peer-to-peer or distributed network environment. The one or more processors may form a personal computer (PC), a tablet PC, a set-top box (STB), a Personal Digital Assistant (PDA), a cellular telephone, a web appliance, a network router, switch or bridge, or any machine capable of executing a set of instructions (sequential or otherwise) that specify actions to be taken by that machine.

Where a figure only illustrates a single processor and/or a single memory that carries the computer-readable code, those in the art will understand that many of the components described above are included, but not explicitly shown or described to reduce the risk of obscuring the inventive aspect. For example, while only a single machine is illustrated, the term "machine" shall also be taken to include any collection of machines that individually or jointly execute a set (or multiple sets) of instructions to perform any one or more of the methodologies discussed herein.

Thus, one embodiment of each of the methods described herein is in the form of a computer-readable carrier medium carrying a set of instructions—for example, a computer program—that are for execution on one or more processors. For example, the one or more processors that are part of an apparatus for determining the award of a set of prizes. Thus, as will be appreciated by those skilled in the art, embodiments of the present invention may be embodied as a method, an apparatus such as a special purpose apparatus, an apparatus such as a data processing system, or a computer-readable carrier medium, for example, a computer program product. The computer-readable carrier medium carries computer readable code including a set of instructions that when executed on one or more processors cause a processor or processors to implement a method. Accordingly, aspects of the present invention may take the form of a method, an entirely hardware embodiment, an entirely software embodiment or an embodiment combining software and hardware aspects. Furthermore, the present invention may take the form of carrier medium (for example, a computer program product on a computer-readable storage medium) carrying computer-readable program code embodied in the medium.

The software may further be transmitted or received over a network via a network interface device (exemplified by interface card 4 and communications card 28). While the carrier medium is shown in an exemplary embodiment to be a single medium, the term "carrier medium" should be taken to include a single medium or multiple media (for example, a centralized or distributed database, and/or associated caches and servers) that store the one or more sets of instructions. The term "carrier medium" shall also be taken to include any medium that is capable of storing, encoding or carrying a set of instructions for execution by one or more of the processors and that cause the one or more processors to perform any one or more of the methodologies of the present invention. A carrier medium may take many forms, including but not limited to, non-volatile media, volatile media, and transmission media. Non-volatile media includes, for example, optical, magnetic disks, and magneto-optical disks. Volatile media includes dynamic memory, such as main memory. Transmission media includes coaxial cables, copper wire and fibre optics, including the wires that comprise a bus subsystem. Transmission media also may also take the form of acoustic or light waves, such as those generated during radio wave and infrared data communications. For example, the term "carrier medium" shall accordingly be taken to included, but not be limited to, solid-state memories, a computer product embodied in optical and magnetic media, a medium bearing a propagated signal detectable by at least one processor of one or more processors and representing a set of instructions that when executed implement a method, a carrier wave bearing a propagated signal detectable by at least one processor of the one or more processors and representing the set of instructions a propagated signal and representing the set of instructions, and a transmission medium in a network bearing a propagated signal detectable by at least one processor of the one or more processors and representing the set of instructions.

It will be understood that the steps of methods discussed are performed in one embodiment by an appropriate processor (or processors) of a processing—that is, a computer—system executing instructions—that is, computer-readable code—stored in storage. It will also be understood that the invention is not limited to any particular implementation or programming technique and that the invention may be implemented using any appropriate techniques for implementing the functionality described herein. The invention is not limited to any particular programming language or operating system.

Reference throughout this specification to "one embodiment" or "an embodiment" means that a particular feature, structure or characteristic described in connection with the embodiment is included in at least one embodiment of the present invention. Thus, appearances of the phrases "in one embodiment" or "in an embodiment" in various places throughout this specification are not necessarily all referring to the same embodiment, but may. Furthermore, the particular features, structures or characteristics may be combined in any suitable manner, as would be apparent to one of ordinary skill in the art from this disclosure, in one or more embodiments.

Similarly it should be appreciated that in the above description of exemplary embodiments of the invention, various features of the invention are sometimes grouped together in a single embodiment, figure, or description thereof for the purpose of streamlining the disclosure and aiding in the understanding of one or more of the various inventive aspects. This method of disclosure, however, is not to be interpreted as reflecting an intention that the claimed invention requires more features than are expressly recited in each claim. Rather, as the following claims reflect, inventive aspects lie in less than all features of a single foregoing disclosed embodiment. Thus, the claims following the Detailed Description are hereby expressly incorporated into this Detailed Description, with each claim standing on its own as a separate embodiment of this invention.

Furthermore, while some embodiments described herein include some but not other features included in other embodiments, combinations of features of different embodiments are meant to be within the scope of the invention, and form different embodiments, as would be understood by those in the art. For example, in the following claims, any of the claimed embodiments can be used in any combination as would be understood by a skilled addressee given the benefit of the teaching herein.

Furthermore, some of the embodiments are described herein as a method or combination of elements of a method that can be implemented by a processor of a computer system or by other means of carrying out the function. Thus, a processor with the necessary instructions for carrying out such a method or element of a method forms a means for carrying out the method or element of a method. Furthermore, an element described herein of an apparatus or system embodiment is an example of a means for carrying out the function performed by the element for the purpose of carrying out the invention.

In the description provided herein, numerous specific details are set forth. However, it is understood that embodiments of the invention may be practiced without these specific details. In other instances, well-known methods, structures and techniques have not been shown in detail in order not to obscure an understanding of this description.

As used herein, unless otherwise specified the use of the ordinal adjectives "first", "second", "third", etc., to describe a common object, merely indicate that different instances of like objects are being referred to, and are not intended to imply that the objects so described must be in a given sequence, either temporally, spatially, in ranking, or in any other manner.

In the claims below and the description herein, any one of the terms comprising, comprised of or which comprises is an open term that means including at least the elements/features that follow, but not excluding others. Thus, the term comprising, when used in the claims, should not be interpreted as being limitative to the means or elements or steps listed thereafter. For example, the scope of the expression a device comprising A and B should not be limited to devices consisting only of elements A and B. Any one of the terms including or which includes or that includes as used herein is also an open term that also means including at least the elements/features that follow the term, but not excluding others. Thus, including is synonymous with and means comprising.

Thus, while there has been described what are believed to be the preferred embodiments of the invention, those skilled in the art will recognize that other and further modifications may be made thereto without departing from the spirit of the invention, and it is intended to claim all such changes and modifications as fall within the scope of the invention. For example, any formulas given above are merely representative of procedures that may be used. Functionality may be added or deleted from the block diagrams and operations may be interchanged among functional blocks. Steps may be added or deleted to methods described within the scope of the present invention.

Although the invention has been described with reference to a specific examples it will be appreciated that by those skilled in the art that it may be embodied in many other forms.

The claims defining the invention are as follows:

1. Apparatus for determining an award of a set of prizes where each prize in the set has a respective prize value, the apparatus including:

memory for storing prize data indicative of prize values ($CP_1 \ldots CP_n$) in the set;

an input device configured to receive input signals from a respective plurality of slot machines, each of the slot machines including an acceptor configured to receive credit value to establish a credit balance, a wager input device configured to receive one or more wagers from one or more players, each wager being deducted from the credit balance, and a redemption device configured to enable the one or more players to redeem the credit balance;

a component configured to:

(i) process the input signals for successive time periods, thereby to determine a contribution amount based on the wagers received at the slot machines for each time period;

(ii) access weighting data, wherein the weighting data includes a weighting value ($W_1 \ldots W_n$) respectively associated with each prize value ($CP_1 \ldots CP_n$), wherein the weighting values define relative proportions of the contribution amount applied to the respective prize values such that the contribution amount is divided between the prize values for each time period; and (iii) for each time period, apply the weighting values to the contribution amount, thereby to determine a plurality of increment values ($IV_1 \ldots IV_n$), such that each increment value ($IV_1 \ldots IV_n$) corresponds to a respective weighting value ($W_1 \ldots W_n$) and a respective prize value ($CP_1 \ldots CP_n$);

an increment device configured to maintain, for each prize value ($CP_1 \ldots CP_n$) a respective corresponding accumulated value ($AV_1 \ldots AV_n$), wherein the increment device is configured to receive data indicative of the increment values ($IV_1 \ldots IV_n$) for each period and, in response, increment in parallel one or more of the corresponding accumulated values ($AV_1 \ldots AV_n$), towards the prize values ($CP_1 \ldots CP_n$); and a comparator configured to determine, for each period, whether incrementing of the accumulated values ($AV_1 \ldots AV_n$) has caused one or more of the accumulated values ($AV_1 \ldots AV_n$) to meet or exceed its associated prize value ($CP_1 \ldots CP_n$) and, if so, generate an award signal for those one or more prize values, set the weighting values associated with those one or more prize values to zero, and increase the weighting values not associated with those one or more prize values such that the contribution amount is divided between the prize values for which the weighting value is non-zero.

2. Apparatus according to claim 1 further comprising a component configured to enable the operator to selectively vary one or more of the weighting values ($W_1 \ldots W_n$) for a given time, thereby to cause a corresponding increased rate of accumulation for one or more of the plurality of increment values ($IV_1 \ldots IV_n$).

3. Apparatus according to claim 1 wherein each weighting value ($W_1 \ldots W_n$) is either zero or greater than zero.

4. Apparatus according to claim 1 wherein, during a first one of the successive time periods, each weighting value ($W_1 \ldots W_n$) is greater than zero.

5. Apparatus according to claim 1 wherein, in relation to a first one of the successive time periods and a subsequent second one of the successive time periods, the input device is responsive to the input signals received during the second time period subsequent to the first time period for setting at least one weighting value at greater than zero.

6. Apparatus according to claim 5 wherein the input device is responsive to the input signals received during the second time period for setting all weighting values at greater than zero.

7. Apparatus according to claim 5 wherein the weighting values remain fixed for the first and second time periods.

8. Apparatus according to claim 1, wherein the input signals are indicative of respective contribution data for each of the plurality of slot machines.

9. Apparatus according to claim 8 wherein the contribution data is indicative of a financial contribution.

10. Apparatus according to claim 1 wherein the comparator is responsive to the award signal for determining if the set contains any prize values that have not defined a corresponding current prize value.

11. Apparatus for determining an award of a set of prizes where each prize has a respective prize value ($CP_1 \ldots CP_n$) and a respective accumulation state defined by a corresponding accumulated value ($AV_1 \ldots AV_n$), the apparatus including:

memory for storing prize data indicative of the prize values ($CP_1 \ldots CP_n$) and the accumulated values ($AV_1 \ldots AV_n$);

an input device configured to receive input signals from a respective plurality of slot machines, each of the slot machines including an acceptor configured to receive credit value to establish a credit balance, a wager input device configured to receive one or more wagers from one or more players, each wager being deducted from the credit balance, and a redemption device configured to enable the one or more players to redeem the credit balance;

a component configured to:

(i) process the input signals for successive time periods, thereby to determine a contribution amount based on the wagers received at the slot machines for each time period;

(ii) access weighting data, wherein the weighting data includes a weighting value ($W_1 \ldots W_n$) respectively associated with each prize value ($CP_1 \ldots CP_n$), wherein the weighting values define relative proportions of the contribution amount applied to the respective prize values such that the contribution amount is divided between the prize values for each time period; and (iii) for each time period, apply the weighting values to the contribution amount, thereby to determine a plurality of increment values ($IV_1 \ldots IV_n$), such that each increment value ($IV_1 \ldots IV_n$) corresponds to a respective weighting value ($W_1 \ldots W_n$) and a respective prize value ($CP_1 \ldots CP_n$);

an increment device configured to selectively increment, in parallel, the accumulated values ($AV_1 \ldots AV_n$) towards their corresponding prize values ($CP_1 \ldots CP_n$) based on the corresponding defined increment values ($IV_1 \ldots IV_n$); and a comparator configured to determine, for each successive period, compare the prize values ($CP_1 \ldots CP_n$) and the corresponding accumulated values ($AV_1 \ldots AV_n$) thereby to determine if one or more of the current prize values are to be awarded and, if so, generating an award signal, setting the weighting values associated with those one or more prize values to zero, and increasing the weighting values not associated with those one or more prize values such that the contribution amount is divided between the prize values for which the weighting value is non-zero;

wherein an operator is enabled to selectively vary one or more of the weighting values ($W_1 \ldots W_n$) for a given time, thereby to cause a corresponding increased rate of accumulation for one or more of the plurality of increment values ($IV_1 \ldots IV_n$).

12. Apparatus according to claim 11 wherein the processor is responsive to the award signal for refreshing all the accumulation states.

13. Apparatus according to claim 12 wherein the refreshing of the accumulation states includes: changing the accumulation states or re-writing an existing state.

14. Apparatus according to claim 11 wherein the accumulation states are such that the increment device initially increments in parallel all the accumulated values.

15. Apparatus according to claim 14 wherein the processor is responsive to successive award signals for reducing the number of accumulated values being incremented in parallel by the increment device.

16. Apparatus according to claim 11 wherein the accumulation states are such that the increment device initially increments in parallel a predetermined number of the accumulated values, where the predetermined number is less than the available number of prizes.

17. Apparatus according to claim 16 wherein the processor, in response to the award signal, refreshes the accumulation states such that the predetermined number of accumulated values are being incremented in parallel.

18. A processor-implemented method for determining an award of a set of prizes where each prize in the set has a respective prize value ($CP_1 \ldots CP_n$), the method including the steps of:

storing prize data indicative of prize values ($CP_1 \ldots CP_n$) in the set;

receiving input signals from a respective plurality of slot machines, each of the slot machines including an acceptor configured to receive credit value to establish a credit balance, a wager input device configured to receive one or more wagers from one or more players, each wager being deducted from the credit balance, and a redemption device configured to enable the one or more players to redeem the credit balance;

processing received input signals for successive time periods, thereby to determine a contribution amount based on the wagers received at the slot machines for each time period;

accessing weighting data, wherein the weighting data includes a weighting value ($W_1 \ldots W_n$) respectively associated with each prize value ($CP_1 \ldots CP_n$), wherein the weighting values define relative proportions of the contribution amount applied to the respective prize values such that the contribution amount is divided between the prize values for each time period; and for each time period, applying the weighting values to the contribution amount, thereby to determine a plurality of increment values ($IV_1 \ldots IV_n$), such that each increment value ($IV_1 \ldots IV_n$) corresponds to a respective weighting value ($W_1 \ldots W_n$) and a respective prize value ($CP_1 \ldots CP_n$);

operating an increment device configured to maintain, for each prize value ($CP_1 \ldots CP_n$) a respective corresponding accumulated value ($AV_1 \ldots AV_n$), wherein the increment device is configured to receive data indicative of the increment values ($IV_1 \ldots IV_n$) for each period and, in response, increment in parallel one or more of the corresponding accumulated values ($AV_1 \ldots AV_n$), towards the prize values ($CP_1 \ldots CP_n$); and determining, for each period, whether incrementing of the accumulated values ($AV_1 \ldots AV_n$) has caused one or more of the accumulated values ($AV_1 \ldots AV_n$) to meet or exceed its associated prize value ($CP_1 \ldots CP_n$) and, if so, generating an award signal for those one or more prize values, setting the weighting values associated with those one or more prize values to zero, and increasing the weighting values not associated with those one or more prize values such that the contribution amount is divided between the prize values for which the weighting value is non-zero.

19. The method according to claim 18 further comprising a step of enabling an operator to selectively vary one or more of the weighting values ($W_1 \ldots W_n$) for a given time, thereby to cause a corresponding increased rate of accumulation for one or more of the plurality of increment values ($IV_1 \ldots IV_n$).

* * * * *